United States Patent [19]

Fulton

[11] Patent Number: 4,524,890

[45] Date of Patent: Jun. 25, 1985

[54] COLLAPSIBLE GARMENT HANGER

[76] Inventor: John D. Fulton, 117 Becker Ave., Rochelle Park, N.J. 07662

[21] Appl. No.: 576,551

[22] Filed: Feb. 3, 1984

[51] Int. Cl.[3] ..... A47J 51/10

[52] U.S. Cl. ..... 223/94; 211/118

[58] Field of Search ..... 223/89, 90, 94; 211/118

[56] References Cited

U.S. PATENT DOCUMENTS 2,452,346 10/1948 Appleman ..... 223/90

2,738,908 3/1956 White ..... 223/89

FOREIGN PATENT DOCUMENTS 989901 5/1951 France ..... 223/94

*Primary Examiner*—Robert R. Mackey

[57] ABSTRACT

A garment hanger having a pair of pivotable arms which are joined through a rack and pinion which allows the user to extend or collapse the hanger using only one hand. The rack and pinion provides for smooth pivoting of the arms and a latch is provided to secure the hanger in an extended posture. The arms have a greater thickness along their extremities to provide protection for the garments and to allow the arms to collapse in an overlapping fashion to provide for compact storage.

2 Claims, 5 Drawing Figures

COLLAPSIBLE GARMENT HANGER

BACKGROUND OF THE INVENTION

1. Field Of The Invention

This invention relates to an improved collapsible garment hanger formed from plastic or other materials and having a pair of pivotable arms which are connected through a rack and pinion which will provide a smooth pivoting action and convenience for the user.

2. Description Of The Prior Art And Objectives Of The Invention

Various garment hangers have been constructed in the past utilizing one or more pivoting arms as shown by U.S. Pat. Nos. 2,137,700; 2,166,492 and 2,872,090. However, many of the prior art devices require the user to utilize both hands of the user in either the extension or the collapsing of the particular devices and consequently the garments must be either placed on a work table or the like or be held under the user's arm for a short period of time. While this may not be an apparent disadvantage for an individual, manufacturing facilities and retail outlets are concerned about the unnecessary time spent by their employees hanging garments and an equal concern is present regarding the unneccessary handling of garments which can cause them to be soiled, wrinkled and otherwise lose their sales appeal.

With this knowledge in mind, one of the objectives of the present invention is to provide a garment hanger which can be collapsed or extended with only one hand of the user while the other hand can remain free to hold and position the garment.

It is another objective of the invention to provide a garment hanger having a pair of pivotal arms which overlap when collapsed to provide compactness in storage and ease in garment hanging.

It is still another objective of the present invention to provide a collapsible garment hanger having a latch for maintaining the pivotable arms in their extended posture.

Various other objectives and advantages of the present invention will become apparent during the more complete description of the invention as set forth below.

BRIEF SUMMARY OF THE INVENTION

The objectives of the invention as set forth above are accomplished by providing a collapsible hanger having a pair of pivotable arms which are joined to a support hook. A rack and pinion mechanism is provided which allows both arms to pivot around a central axis in arcs of approximate equal length while the pinion guides the arcuate rack. An extension lever is provided proximate the support hook so the user, by grasping the hook, can fully extend or collapse the arms using only one hand while the other hand remains free to support or straighten the garment on the hanger.

DESCRIPTION OF THE PREFERRED EMBODIMENT

Figure 1:
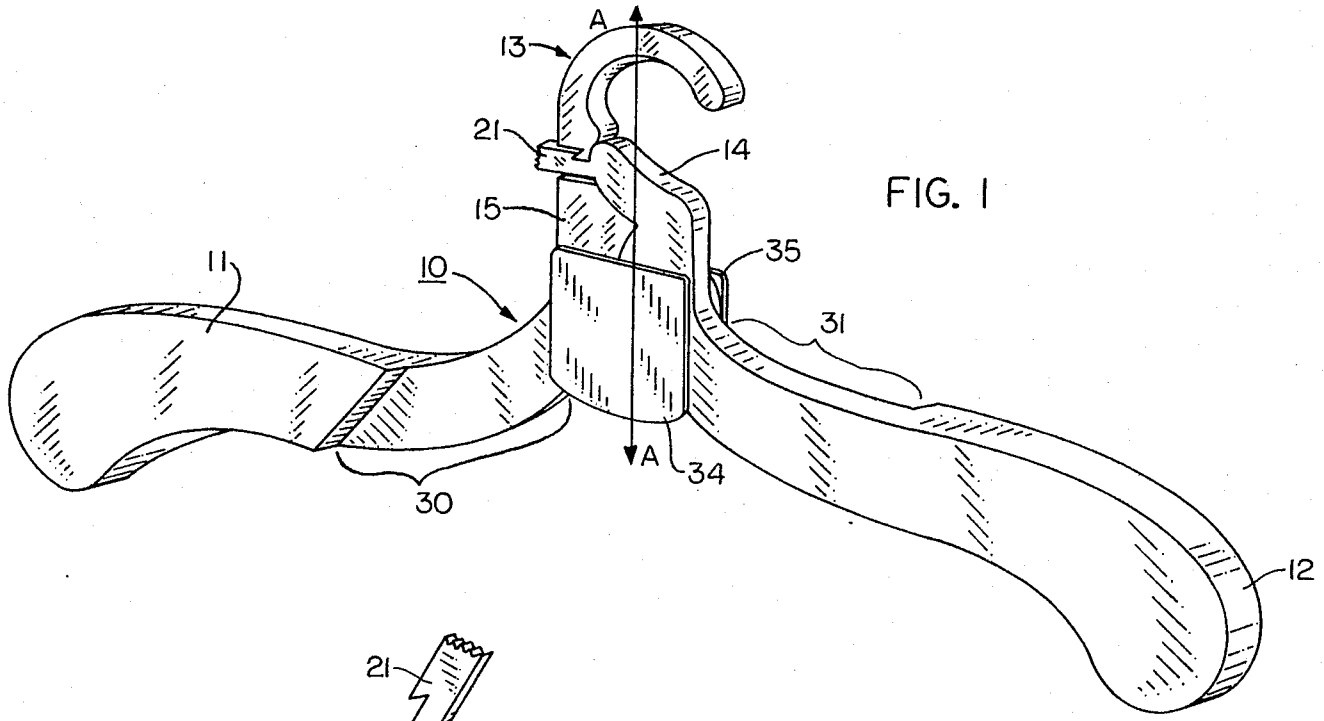
FIG. 1 is a perspective view of the garment hanger of the present invention shown in an open or extended posture.

The preferred embodiment of the invention is shown in FIG. 1 where garment hanger 10 is depicted in an open or extended posture with left arm 11 and right arm 12 being maintained as to support a sweater, blouse or other garment. The pivoting action of arms 11 and 12 is facilitated by a rack and pinion mechanism (not shown in FIG. 1) which allows a user with a small hand to grip support hook 13 and to open hanger 10 by urging extension lever 14 into engagement with neck portion 15 of support hook 13. Arms 11 and 12 as shown in FIG. 1 have notched portions 30 and 31 respectively on left arm 11 and right arm 12 as shown in FIG. 1 to allow the arms to overlap when collapsed or closed for ease of insertion into a garment such as into a small neck of a sweater or for storage purposes.

DETAILED DESCRIPTION OF THE DRAWINGS

Figure 3:
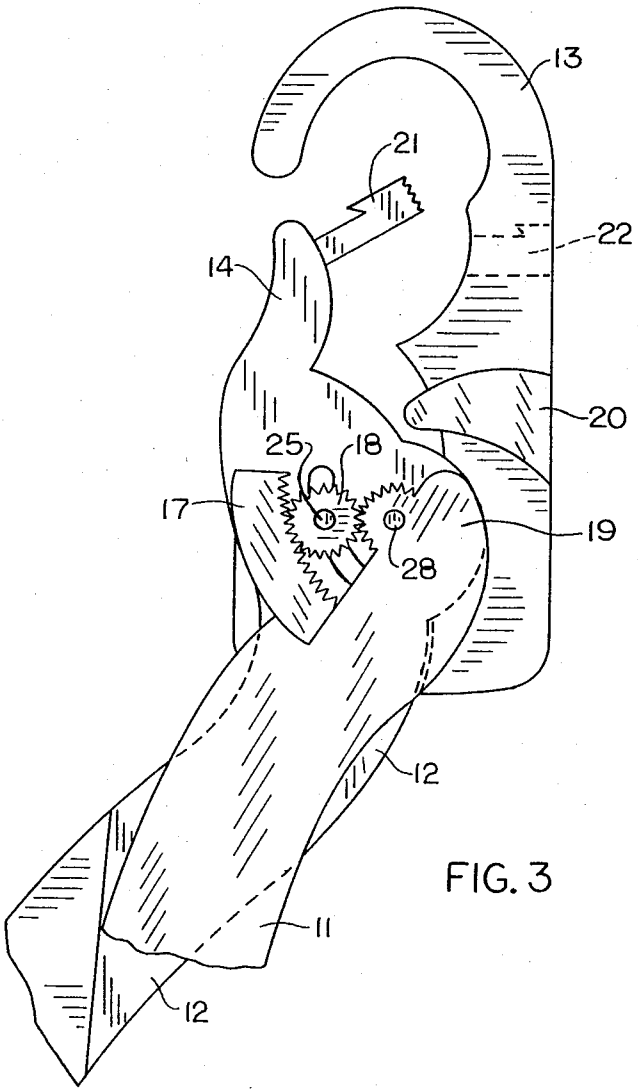
FIG. 3 demonstrates the rack and pinion mechanism with the garment hanger in the closed or collapsed position.
Figure 2:
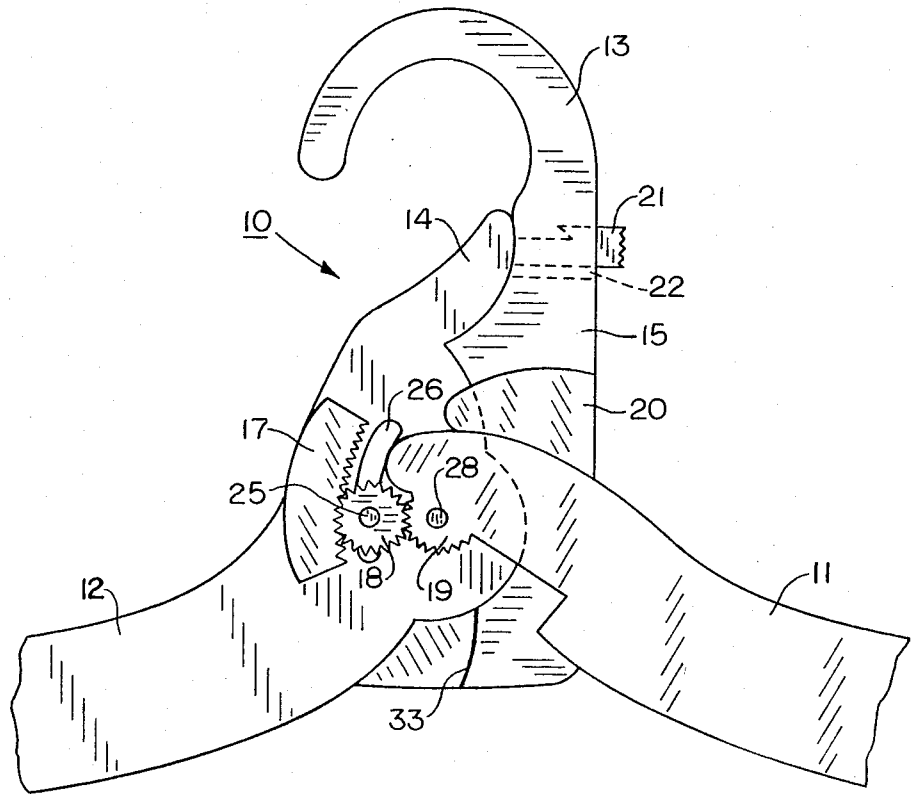
FIG. 2 demonstrates the rack and pinion mechanism with the hanger in the open position.

FIG. 2 demonstrates the internal rack and pinion mechanism of garment hanger 10 in the open position with arms 11 and 12 fully extended. Arm 12, which is shown on the right side in FIG. 1 and on the left side in FIG. 2, includes an extension lever 14 which, by finger pressure closes against neck portion 15 of support hook 13. Also included on arm 12 is arcuate rack 17 which meshes with pinion 18. Pinion drive means 19 is connected to right arm 11 as shown in FIG. 2, so that the user, by gripping support hook 13 in one hand, can reach extension lever 14 with hanger 10 in a collapsed posture as shown in FIG. 3, and can thereby extend arms 11 and 12. As shown in FIG. 3, pinion 18 guides arcuate rack 17 to a downward position. As further shown in FIG. 2, when the garment hanger is extended, pinion 18 guides arcuate rack 17 to an upward position. Pinion 18 rotates around axle 25. Stop means 20 is positioned above pinion drive means 19 as shown in FIGS. 2 and 3 and prevents additional upward movement of arm 11 and curved stop means 33 as shown in FIG. 2 prevents further downward movement by arm 12.

Figure 4:
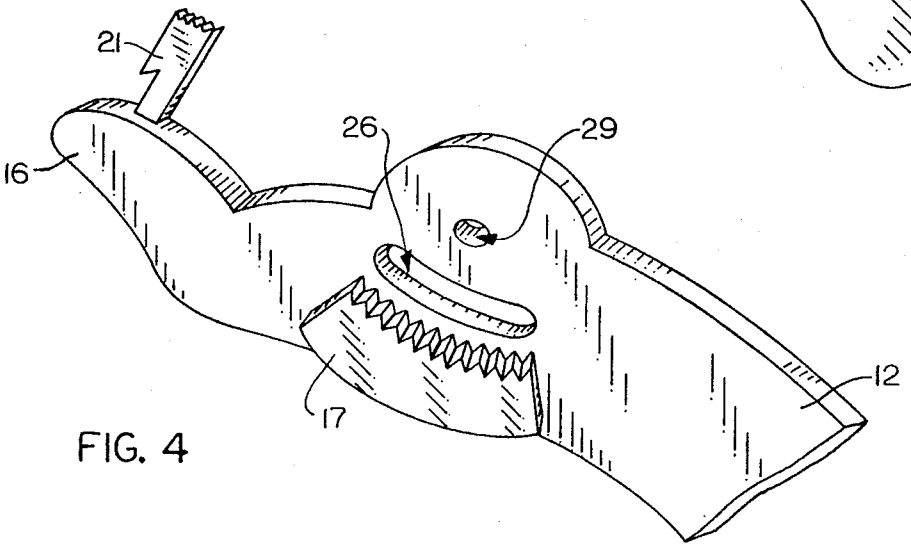
FIG. 4 shows a partial perspective view of the right arm of the garment hanger as would be seen in FIG. 1 with the arcuate rack joined thereto.

FIG. 4 shows a portion of arm 12 with arcuate rack 17 joined thereto and with latch means 21 positioned thereon. Latch means 21 fits within latch receiving slot 22 with arms 11 and 12 extended as shown in FIG. 1 and FIG. 2 and the terminal end of latch means 21 extends beyond neck portion 15 so the user can easily release latch means 21 by a quick thumb depression.

Pinion 18 is joined to an axle 25 as shown in FIG. 2 which axle is anchored to cover plates 34 and 35. Slot 26 as shown in FIG. 4 allows arm 12 to rotate relative to pinion 18. Both left arm 11 and right arm 12 pivot around central axle 28 as shown in FIG. 2 and as shown axle 28 passes through axle receiving opening 29 in FIG. 4. Axle 28 is, like axle 25, anchored to cover plates 34 and 35.

Figure 5:
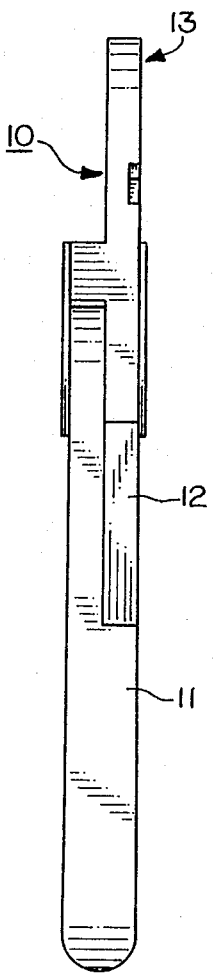
FIG. 5 demonstrates a view from the left side with the hanger in a closed configuration.

Garment hanger 10 provides for compact storage as shown in FIG. 5 whereby arms 11 and 12 overlap and this overlapping action allows hanger 10 to be easily placed within small garments.

Garment hanger 10 can be easily manipulated by a user with a small hand such as by a child or other person due to the rack and pinion mechanism which allows both arms to extend and collapse around a central axis A—A as shown in FIG. 1 with minimal movement of extension lever 14.

Various modifications and changes can be made to the invention as shown herein without departing from its scope and the examples and illustrations are only for explanatory purposes.

I claim:

1. A collapsible garment hanger comprising: a support hook, a pair of pivotable arms, an axle, both of said arms connected to said axle for pivoting therearound independent of said support hook, a first of said pair of arms including a rack and the second of said arms including pinion drive means, a pinion, said pinion mounted for rotation about a stationary axle, said stationary axle extending through an arcuate slot in said first of said pair of arms, said pinion meshing with said rack and said pinion drive means for movement relative to said rack, said first arm including an extension lever, said lever having a latch means and said support hook having a neck with an opening therethrough for reception of said latch means to maintain said arms in an extended position and upon release of said latch means from the neck opening, the garment hanger being collapsible whereby said arms can overlap for compact storage.

2. A collapsible garment hanger comprising: a pair of pivotable arms, a first of said pair of arms including an arcuate rack, the second of said arms including a pinion drive means, each of said pair of arms having a notched portion, a pinion, said pinion mounted for rotation about a stationary axle, said axle extending through an arcuate slot in said first arm, said pinion engaging said rack for movement relative thereto, said pinion engaging said drive means, a support hook, said hook having a neck with an opening therethrough, a second axle, both of said arms connected to said second axle for pivoting therearound independent of said support hook, said hook rotatably joined to said pair of arms, an extension lever, said lever connected to said first of said arms, said lever including a latch means for reception by said neck opening for maintaining said arms in an extended position and upon release of said latch means from the neck opening, the garment hanger being collapsible whereby said arms can overlap for compact storage.

* * * * *